US006827579B2

(12) United States Patent
Burdea et al.

(10) Patent No.: US 6,827,579 B2
(45) Date of Patent: Dec. 7, 2004

(54) METHOD AND APPARATUS FOR REHABILITATION OF NEUROMOTOR DISORDERS

(75) Inventors: Grigore C. Burdea, Highland Park, NJ (US); Rares Boian, Piscataway, NJ (US)

(73) Assignee: Rutgers, The State University of NJ, New Brunswick, NJ (US)

( * ) Notice: Subject to any disclaimer, the term of this patent is extended or adjusted under 35 U.S.C. 154(b) by 0 days.

(21) Appl. No.: 10/008,406

(22) Filed: Nov. 13, 2001

(65) Prior Publication Data

US 2002/0146672 A1 Oct. 10, 2002

Related U.S. Application Data

(60) Provisional application No. 60/248,574, filed on Nov. 16, 2000, and provisional application No. 60/329,311, filed on Oct. 16, 2001.

(51) Int. Cl.[7] ..... G09B 19/00

(52) U.S. Cl. ..... 434/258; 434/247; 434/262; 434/274

(58) Field of Search ..... 434/258, 247, 434/262, 374, 350, 322, 323, 219; 600/587, 592–595

(56) References Cited

U.S. PATENT DOCUMENTS 5,354,162 A 10/1994 Burdea et al.
5,429,140 A * 7/1995 Burdea et al. ..... 600/587
5,527,244 A 6/1996 Waller et al.
5,720,619 A * 2/1998 Fisslinger ..... 434/336
5,800,178 A * 9/1998 Gillio ..... 434/262
5,846,086 A 12/1998 Bizzi et al.
5,976,063 A 11/1999 Joutras et al.
6,057,846 A 5/2000 Sever, Jr.
6,162,189 A 12/2000 Girone et al.
6,213,918 B1 4/2001 Rogers, Jr.
6,413,229 B1 * 7/2002 Kramer et al. ..... 600/595
6,425,764 B1 * 7/2002 Lamson ..... 434/236

* cited by examiner

*Primary Examiner*—Jessica Harrison
*Assistant Examiner*—John Sotomayor
(74) *Attorney, Agent, or Firm*—Mathews, Collins, Shepherd & McKay, P.A.

(57) ABSTRACT

The invention relates to a method and system for individually exercising one or more parameters of hand movement such as range, speed, fractionation and strength in a virtual reality environment and for providing performance-based interaction with the user to increase user motivation while exercising. The present invention can be used for rehabilitation of neuromotor disorders, such as a stroke. A first input device senses position of digits of the hand of the user while the user is performing an exercise by interacting with a virtual image. A second input device provides force feedback to the user and measures position of the digits of the hand while the user is performing an exercise by interacting with a virtual image. The virtual images are updated based on targets determined for the user's performance in order to provide harder or easier exercises.

49 Claims, 19 Drawing Sheets

METHOD AND APPARATUS FOR REHABILITATION OF NEUROMOTOR DISORDERS

This application claims priority of U.S. Provisional Application Ser. No. 60/248,574 filed Nov. 16, 2000 and U.S. Provisional Application Ser. No. 60/329,311 filed Oct. 16, 2001, which are hereby incorporated by reference in their entireties.

BACKGROUND OF THE INVENTION

1. Field of the Invention

The present invention relates to a method and apparatus for rehabilitation of neuromotor disorders such as improving hand function, in which a system provides virtual reality rehabilitation exercises with index of difficulty determined by the performance of a user (patient).

2. Description of the Related Art

The American Stroke Association states that stroke is the third leading cause of death in the United States and a major cause for serious, long-term disabilities. Statistics show that there are more than four million stroke survivors living today in the US alone, with 500,000 new cases being added each year. Impairments such as muscle weakness, loss of range of motion, decreased reaction times and disordered movement organization create deficits in motor control, which affect the patient's independent living.

Prior art therapeutic devices involve the use of objects which can be squeezed such as balls which are held in the patient's hand and the patient is instructed to apply increasing pressure on the surface of the ball. This device provides for resistance of the fingers closing relative to the palm, but has the limitation of not providing for exercise of finger extensions and finger movement relative to the plane of the palm and does not provide for capturing feedback from the patient's performance online.

It has been described that intensive and repetitive training can be used to modify neural organization and recover functional motor skills For post-stroke patients in the chronic phase. See for example, Jenkins, W. and M. Merzenich, "Reorganization of Neocortical Representations After Brain Injury: A Neurophysiological Model of the Bases of Recovery From Stroke," in *Progress in Brain*, F. Seil, E. Herbert and B. Carlson, Editors, Elsevier, 1987; Kopp, Kunkel, Muehlnickel, Villinger, Taub and Flor, "Plasticity in the Motor System Related to Therapy-induced Improvement of Movement After Stroke," *Neuroreport*, 10(4), pp. 807–10, Mar. 17, 1999; Nudo, R. J., "Neural Substrates for the Effects of Rehabilitative Training on Motor Recovery After Ischemic Infarction," *Science*, 272: pp. 1791–1794, 1996; and Taub, E. et al., "Technique to Improve Chronic Motor Deficit After Stroke," *Arch Phys Med Rehab*, 1993, 74: pp. 347–354.

When traditional therapy is provided in a hospital or rehabilitation center, the patient is usually seen for half-hour sessions, once or twice a day. This is decreased to once or twice a week in outpatient therapy. Typically, 42 days pass from the time of hospital admission to discharge from the rehabilitation center, as described in P. Rijken and J. Dekker, "Clinical Experience of Rehabilitation Therapists with Chronic Diseases: A Quantitative Approach," *Clin. Rehab*, vol. 12, no. 2, pp. 143–150, 1998. Accordingly, in this service-delivery model, it is difficult to provide the amount or intensity of practice needed to effect neural and functional changes. Furthermore, little is done for the millions of stroke survivors in the chronic phase, who face a lifetime of disabilities.

Rehabilitation of body parts in a virtual environment has been described. U.S. Pat. No. 5,429,140 issued to one of the inventors of the present invention teaches applying force feedback to the hand and other articulated joints in response to a user (patient) manipulating an virtual object. Such force feedback may be produced by an actuator system for a portable master support (glove) such as that taught in U.S. Pat. No. 5,354,162 issued to one of the inventors on this application. In addition, U.S. Pat. No. 6,162,189 issued to one of the inventors of the present invention, describes virtual reality simulation of exercises for rehabilitating a user's ankle with a robotic platform having six degrees of freedom.

SUMMARY OF THE INVENTION

The invention relates to a method and system for individually exercising one or more parameters of hand movement such as range, speed, fractionation and strength in a virtual reality environment and for providing performance-based interaction with the user (patient) to increase user motivation while exercising. The present invention can be used for rehabilitation of patients with neuromotor disorders, such as a stroke. A first input device senses position of digits of the hand of the user while the user is performing an exercise by interacting with a virtual image. A second input device provides force feedback to the user and measures position of the digits of the hand while the user is performing an exercise by interacting with a virtual image. The virtual images are updated based on targets determined for the user's performance in order to provide harder or easier exercises. Accordingly, no matter how limited a user's movement is, if the user performance falls within a determined parameter range the user can pass the exercise trial and the difficulty level can be gradually increased. Force feedback is also applied based on the user's performance, and its profile is based on the same targeting algorithm.

The data of the user's performance can be stored and reviewed by a therapist. In one embodiment, the rehabilitation system is distributed between a rehabilitation site, a data storage site and a data access site through an Internet connection between the sites. The virtual reality simulations provide an engaging environment that can help a therapist to provide an amount or intensity of exercises needed to effect neural and functional changes in the patient. The invention will be more fully described by reference to the following drawings.

In a further embodiment, the data access site includes software that allows the doctor/therapist to monitor the exercises performed by the patient in real time using a graphical image of the patient's hand.

DETAILED DESCRIPTION

Figure 1:
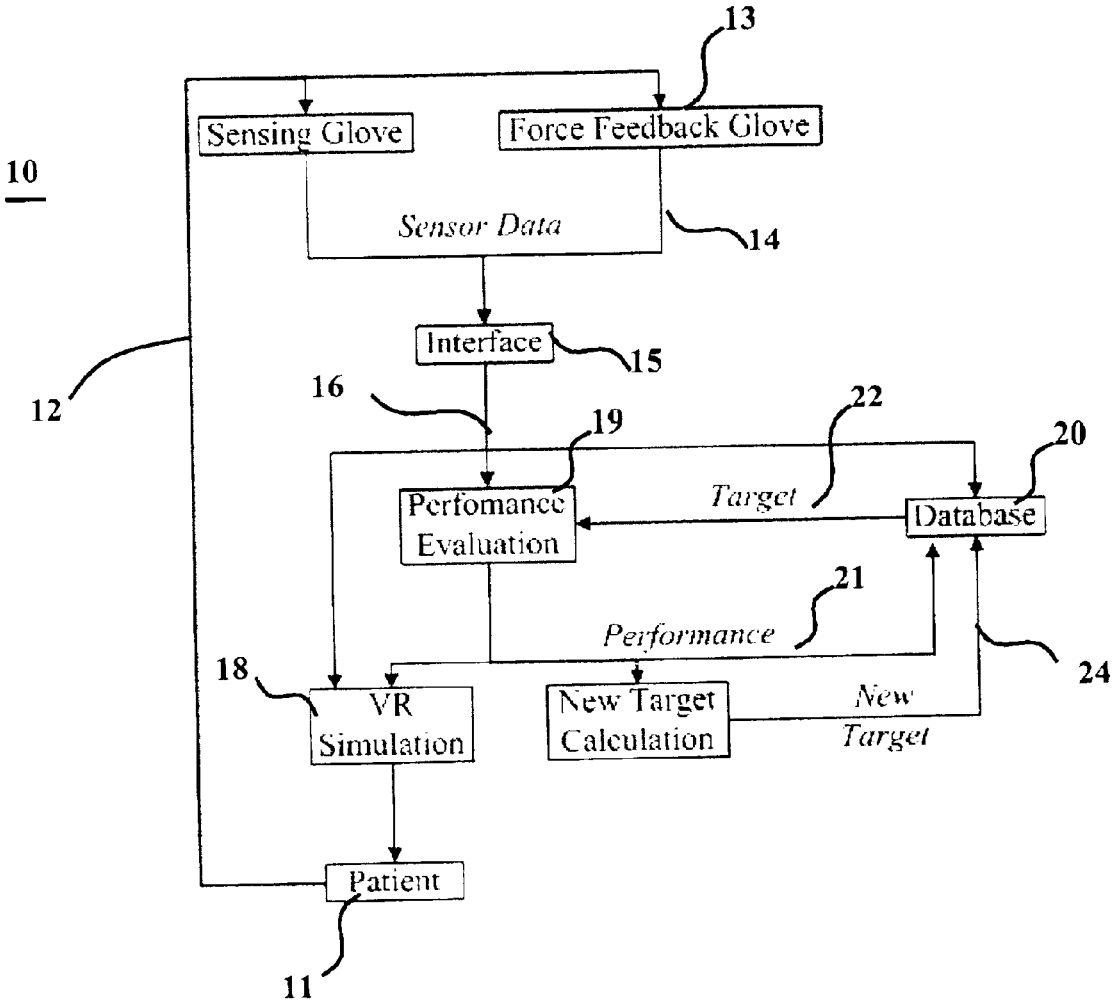
FIG. 1 is a schematic diagram of a rehabilitation system in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of rehabilitation system 10 in accordance with the teachings of the present invention. Patient 11 can interact with sensing glove 12. Sensing glove 12 is a sensorized glove worn on the hand for measuring positions of the patient's fingers and wrist flexion. A suitable such sensing glove 12 is manufactured by Virtual Technologies, Inc. as the CyberGlove™. For example, sensing glove 12 can include a plurality of embedded strain gauge sensors for measuring metacarpophalangeal (MCP) and proximal interphalangeal (PIP) joint angles of the thumb and fingers, finger abduction and wrist flexion. Sensing glove 12 can be calibrated to minimize measurement errors due to hand-size variability. The patient's hand joint is placed into two known positions of about 0° and about 60°. From these measurements, parameters of gain and offset are obtained that determine the linear relation between the raw glove-sensor output (voltages) and the corresponding hand-joint angles being measured. An alternative way of calibration is to use goniometers placed over each finger joint and map the readings to those obtained from sensing glove 12. Sensing glove 12 can be used for exercises which involve position measurements of the patient's fingers, as described in more detail below.

Patient 11 can also interact with force feedback glove 13. For example, force feedback glove 13 can apply force to fingertips of patient 11 and includes noncontact position sensors to measure the fingertip position in relation to the palm. A suitable force feedback glove is described in PCT/US00/19137; D. Gomez, "A Dextrous Hand Master With Force Feedback for Virtual Reality," Ph.D. Dissertation, Rutgers University, Piscataway, N.J., May 1997 and V. Popescu, G. Burdea, M. Bouzit, M. Girone and V. Hentz, "Orthopedic Telerehabilitation with Virtual Force Feedback," *IEEE Trans. Inform. Technol. Biomed*, Vol. 4, pp. 45–51, March 2000, hereby incorporated by reference in their entireties into this application. Force feedback glove 13 can be used for exercises which involve strength and endurance measurements of the user's fingers, as described in more detail below.

Figure 2A:
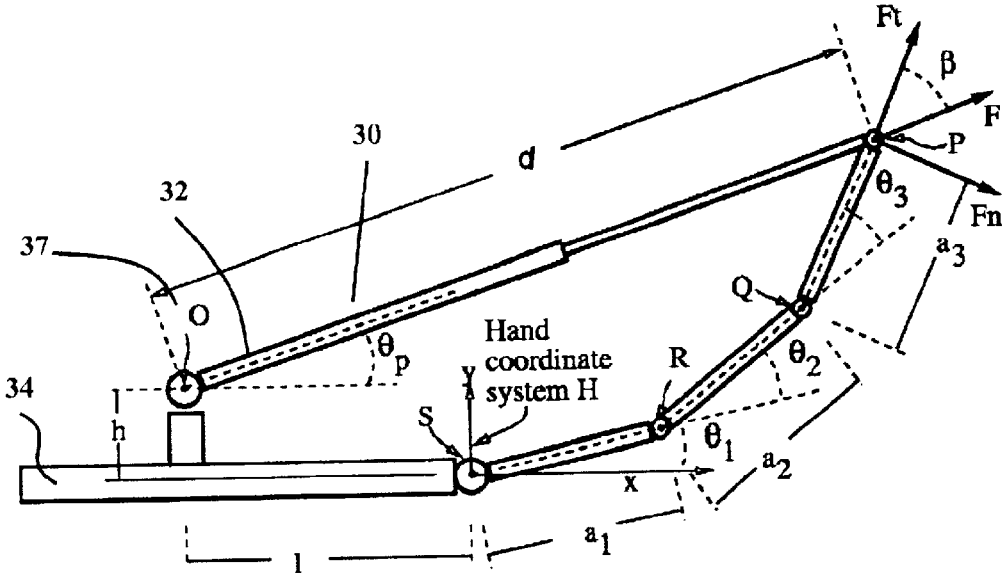
FIG. 2*a* is a schematic diagram of a pneumatic actuator that is used in a force feedback glove of the present invention.
Figure 2B:
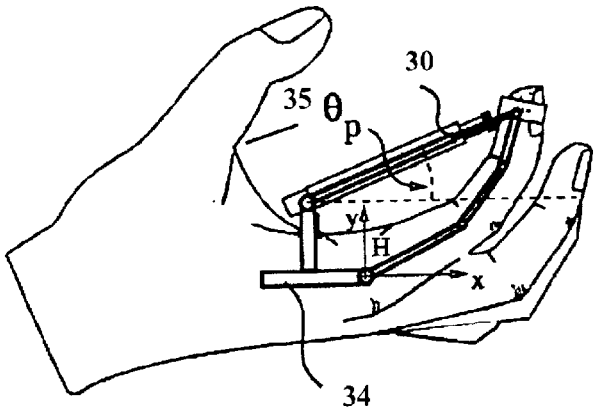
FIG. 2*b* is a schematic diagram of an attachment of the pneumatic actuator to a digit of a hand.
Figure 2C:
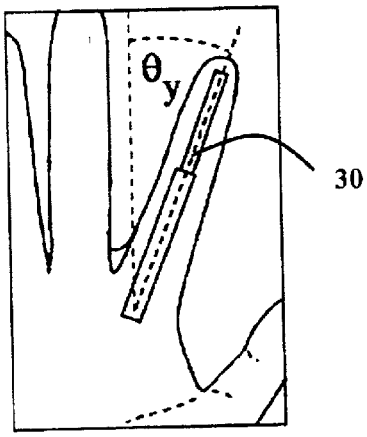
FIG. 2*c* is a schematic diagram of measurement of a rotation angle of the digit.

FIGS. 2*a*–2*c* illustrate an embodiment of a pneumatic actuator which can be attached by force feedback glove 13 to the tips of digits of the hand of a thumb, index, middle and ring finger of patient 11. Each pneumatic actuator 30 can apply up to about 16 N of force when pressurized at about 100 psi. The air pressure is provided by a portable air compressor (not shown). Sensors 32 inside each pneumatic actuator 30 measures the displacement of the fingertip with respect to exoskeleton base 34 attached to palm 35. Sensors 32 can be infrared photodiode sensors. Sensors 36 can be mounted at base 37 of actuators 30 to measure flexion and abduction angles with respect to exoskeleton base 34. Sensors 36 can be Hall Effect sensors.

In order to determine the hand configuration corresponding to the values of the exoskeleton position sensors, the joint angles of three fingers and the thumb, as well as finger abduction, can be estimated with a kinematic model.

Representative equations for the inverse kinematics are:

$$a_1S_1+a_2S_{1+2}+a_3S_{1+2+3}=DS_r+h$$

$$a_1C_1+a_2C_{1+2}+a_3C_{1+2+3}=DC_r-1.$$

Additionally, the following constraint equation can be imposed for $\Theta_3$ and $\Theta_2$:

$$\Theta_3=0.46\ \Theta_2+0.083(\Theta_2)^2$$

The system can be solved using least-squares linear interpolation. Calibration of force feedback glove 13 can be performed by reading sensors 32 and 36 while the hand is completely opened. The values read are the maximum piston displacement, minimum flexion angle, and neutral abduction angle.

Referring to FIG. 1, sensor data 14 from sensor glove 12 and force feedback glove 13 is applied to interface 15. For example, interface 15 can include a RS-232 serial port for connecting to sensor glove 12. Interface 15 can also include a haptic control interface (HCI) for controlling desired fingertip forces and calculating joint angles of force feedback glove 13. Interface 15 can receive sensor data 14 at a rate in the range of about 100 to about 200 data sets per second.

Figure 3:
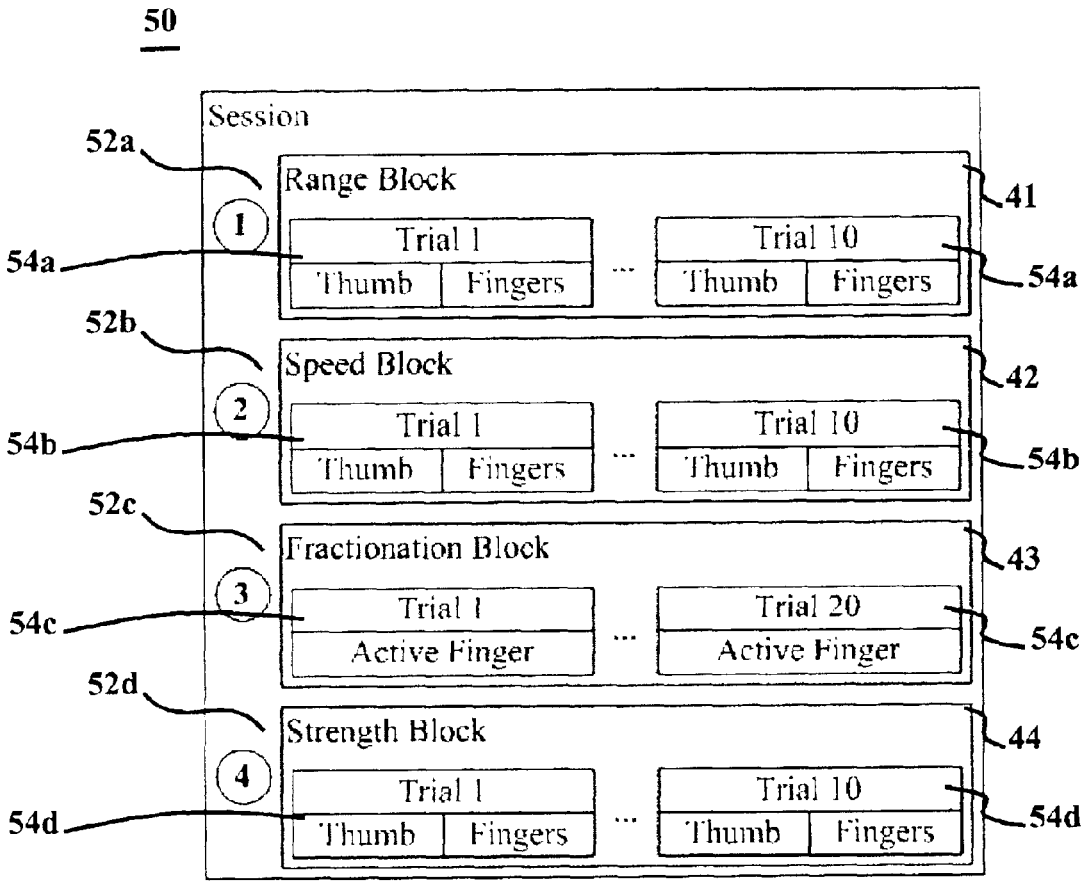
FIG. 3 is a schematic diagram of a rehabilitation session structure.

Data 16 is forwarded from interface 15 to virtual reality simulation module 18, performance evaluation module 19 and database 20. Virtual reality simulation module 18 comprises virtual reality simulations of exercises for concentrating on a particular parameter of hand movement. For example, virtual reality simulations can relate to exercises for range, speed, fractionation and strength, which can be performed by a user of rehabilitation system 10, as shown in FIG. 3. Fractionation is used in this disclosure to refer to independence of individual finger movement. Virtual simulation exercises for range of motion 41 are used to improve a patient's finger flexion and extension. In response to the virtual simulation of exercises for range of motion 41, the user flexes the fingers as much as possible and opens them as much as possible. During virtual simulation of exercises for speed-of-motion 42, the user fully opens the hand and closes it as fast as possible. Virtual simulation exercises for fractionation 43 involve the use of the index, middle, ring, and small fingers. In response to virtual simulation exercises for fractionation 43, the patient flexes one finger as much as possible while the others are kept open. The exercise is executed separately for each of the four fingers. Virtual simulation exercises for strength 44 are used to improve the patient's grasping mechanical power. The fingers involved are the thumb, index, middle, and ring. In response to virtual simulation exercises for strength 44, the patient closes the fingers against forces applied to fingertips by feedback glove 13 to try to overcome forces applied by feedback glove 13. The patient is provided with a controlled level of force based on his grasping capacity.

To reduce fatigue and tendon strain, the fingers are moved together and the thumb is moved alone in response to virtual simulation exercises for range of motion 41, exercises for speed 42 and exercises for strength 44. Each exercise is executed separately for the thumb because, when the whole hand is closed, either the thumb or the four fingers does not achieve full range of motion. Executing the exercise for the index, middle, ring, and small fingers at the same time is adequate for these exercises because the fingers do not affect each-others' range of motion.

The rehabilitation process is divided into session 50, blocks 52*a*–52*d*, and trials 54*a*–54*d*. Trials 54*a*–54*d* comprise execution of each of virtual simulation exercises 41–44. For example, closing the thumb or fingers is a range-of-motion trial 54*a*. Blocks 52*a*–52*d* are a group of trials of the same type of exercise. Session 50 is a group of blocks 52*a*–52*d*, each of a different exercise.

During each trial 54*a*–54*d*, exercise parameters for the respective virtual simulation exercises 41–44 are estimated and displayed as feedback at interface 15. After each trial 54*a*–54*d* is completed, sensor data 14 can be low pass-filtered to reduce sensor noise. For example, sensor data 14 can be filtered at about 8 Hz. Data 16 is evaluated in performance evaluation module 19 and stored in database 20. In performance evaluation module 19, the patient's performance is calculated per trial 54*a*–54*d* and per block 52*a*–52*d*. In performance evaluation module 19, performance can be calculated as the mean and the standard deviation of the performances of trials 54*a*–54*d* involved. For exercises for range of motion 41 and exercises for strength 44, the flexion angle of the finger is the mean of the MCP and PIP joint angles. The performance measure is found from:

$$\max\left(\frac{MCP+PIP}{2}\right)-\min\left(\frac{MCP+PIP}{2}\right).$$

The finger velocity in exercises for speed of motion 42 is determined as the mean of the angular velocities of the MCP and PIP joints. The performance measure is determined by:

$$\max\left(\frac{speed(MCP)+speed(PIP)}{2}\right).$$

Finger fractionation in the exercise for fractionation 43 is determined by:

$$100\%\left(1-\frac{\sum PassiveFingerRange}{3\ ActiveFingerRange}\right)$$

where ActiveFingerRange is the current average joint range of the finger being moved and PassiveFingerRange is the current average joint range of the other three fingers combined. Moving one finger individually results in a measure of 100%, which decays to zero as more fingers are coupled in the movement. The patient moves only one finger while trying to keep the others stationary. This exercise can be repeated four times for each finger.

An initial baseline test is performed of each of exercises 41–44 to determine an initial target 22. The range of movement of force feedback glove 13 is performed to obtain the user's mean range while wearing force feedback glove 13. The user's finger strength is established by doing a binary search of force levels and comparing the range of movement at each level with the mean obtained from the previous range test. If the range is at least 80% of that previously measured, the test is passed, and the force is increased to the next binary level. If the test is failed, then the force is decreased to the next binary level, and so on. Test forces are applied until the maximal force level attainable by the patient is found. During the baseline test for exercise for strength 44, the patient uses force feedback glove 13.

Targets are used in performance evaluation module 19 to evaluate performance 21. A first set of initial targets 22 for the first session, are forwarded from database 20. Initial targets 22 are drawn from a normal distribution around the mean and standard deviations given by the initial evaluation baseline test for each of exercises 41–44. A normal distribution ensures that the majority of the targets will be within the patient's performance limits.

After a blocks 52*a*–52*d* are completed, the distribution of the patient's actual performance 21 is compared to the preset target mean and standard deviations in new target calculation module 23. If the mean of the patient's actual performance 21 is greater than the mean of target 22, target 22 is raised by one standard deviation to form a new target 24. Alternatively, target 22 for the next session is lowered by the same amount to form new target 24. The patient will find some new targets 24 easy or difficult depending on whether they came from the low or high end of the target distribution. Initially, in one embodiment, the target means are set one standard deviation above the user's actual measured performance to obtain a target distribution that overlaps the high end of the user's performance levels. New targets 24 are stored in database 20. Virtual reality simulation module 18 can read database 20 for displaying performance 21, targets 22 and new targets 24. To prevent new targets 24 from varying too little or too much between sessions, lower and upper bounds can be placed by new target calculation module 23 upon their increments. These parameters allow a therapist monitoring use of rehabilitation system 10 by a patient to choose how aggressively each training exercise 41–44 will proceed. A high upper bound means that new targets 24 for the next session are considerably higher than the previous ones. As new targets 24 change over time, they provide valuable information to the therapist as to how the user of rehabilitation system 10 is coping with the rehabilitation training.

Figure 4:
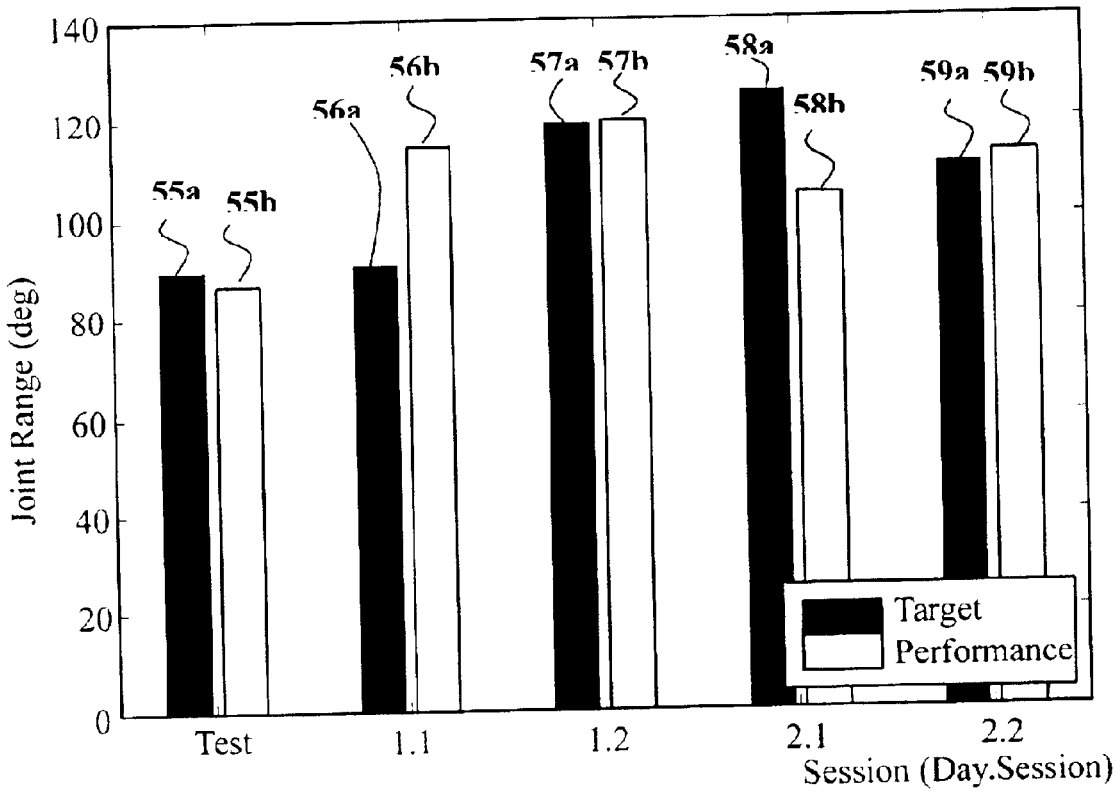
FIG. 4 is a graph of mean performance and target levels of a range of movement of a user's index finger.

The new targets for blocks 52*a*–52*d* and actual mean performance of the index finger during the range exercise are shown for four sessions taken over a two-day period, in FIG. 4. Columns 55*a*–55*b* are the result of the initial subject evaluation target 22 being set from the mean actual performance plus one standard deviation. As the exercises proceed, it can be seen how new targets 24 were altered based upon the subject's performance in columns 56–59. New target 24 of blocks 52*a*–52*d* was increased when the user matched or improved upon the target level, or decreased otherwise.

Virtual reality simulation module 18 can develop exercises using the commercially available WorldToolKit graphics library as described in Engineering Animation Inc., or some other suitable programming toolkit. Virtual reality simulations can take the form of simple games in which the user performs a number of trials of a particular task. Virtual reality simulations of exercises are designed to attract the user's attention and to challenge him to execute the tasks. In one embodiment during the trials, the user is shown a graphical model of his awn hand, which is updated in real time to accurately represent the flexion of his fingers and thumb. The user is informed of the fingers involved in trial 54*a*–54*d* by highlighting the appropriate virtual fingertips in a color, such as green. The hand is placed in a virtual world that is acting upon the patient's performance for the specific exercise. If the performance is higher than the preset target, then the user wins the game. If the target is not achieved in less than one minute, the trial ends.

Figure 5A:
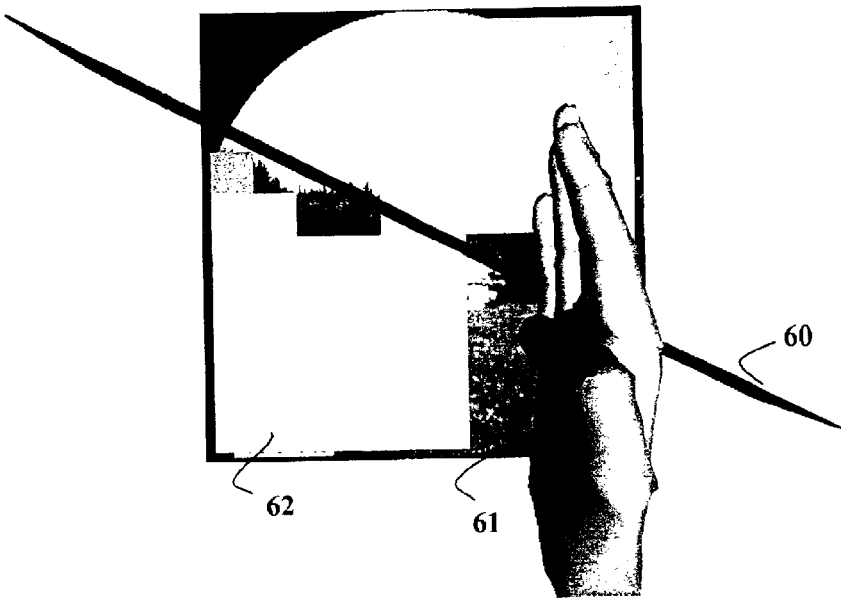
FIG. 5*a* is a pictorial representation of a virtual simulation of an exercise for range of motion.

An example of a virtual simulation of exercise for range of movement 41 is illustrated in FIG. 5*a*. The patient moves a virtual window wiper 60 to reveal an attractive landscape 61 hidden behind the fogged window 62. The higher the measured angular range of movement of the thumb or fingers (together), the more wiper 60 rotates and clears window 62. The rotation of wiper 60 is scaled so that if the user achieves the target range for that particular trial, window 62 is cleaned completely.

Fogged window 62 comprises a two-dimensional (2-D) array of opaque square polygons placed in front of a larger polygon mapped with a landscape texture. Upon detecting the collision with wiper 60, the elements of the array are made transparent, revealing the picture behind it. Collision detection is not performed between wiper 60 and the middle vertical band of opaque polygons because they always collide at the beginning of the exercise. These elements are cleared when the target is achieved. To make the exercise more attractive, the texture (image) mapped on window 62 can be changed from trial to trial.

Figure 5B:
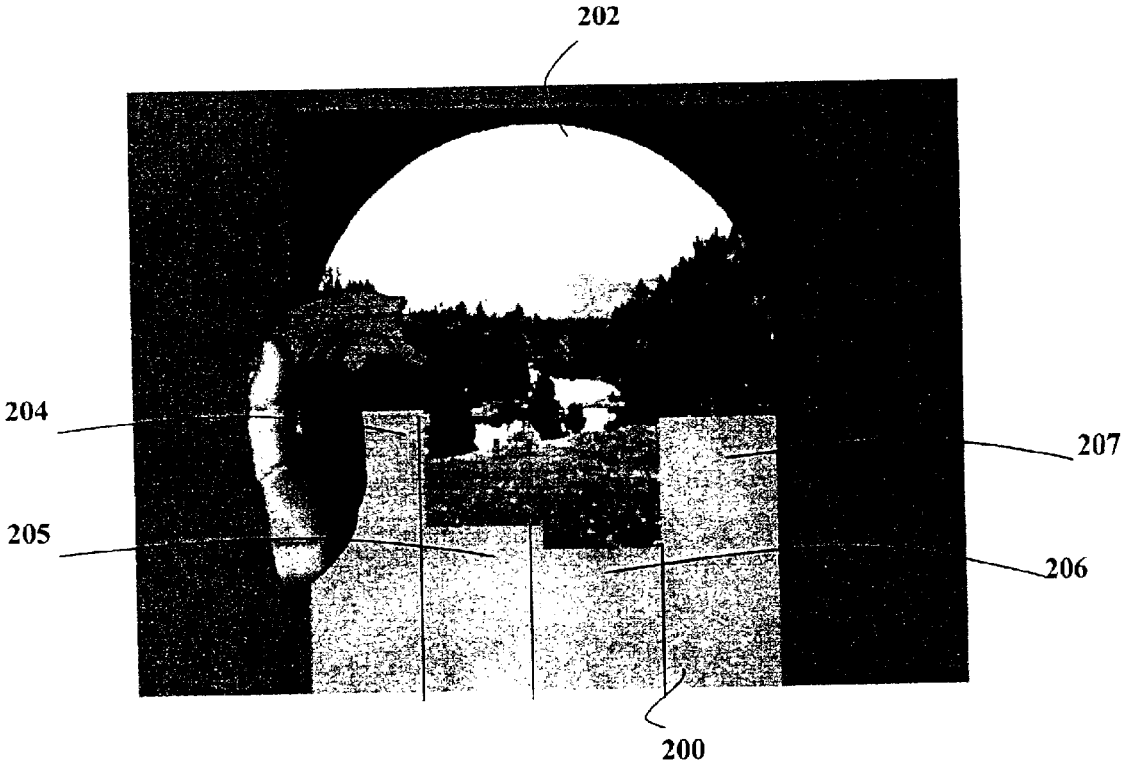
FIG. 5*b* is a pictorial representation of another version of the range of motion exercise in virtual reality.

Another embodiment of the range of motion exercise is shown in FIG. 5*b*. The region of opaque squares covering the textured image is subdivided in four bands 204–207, each corresponding to one finger. Thus the larger the range of motion of the index finger, the larger the corresponding portion of the textured image is revealed. The same process is applied for middle, ring and pinkie fingers, in order to help the therapist see the range of individual fingers.

Figure 6A:
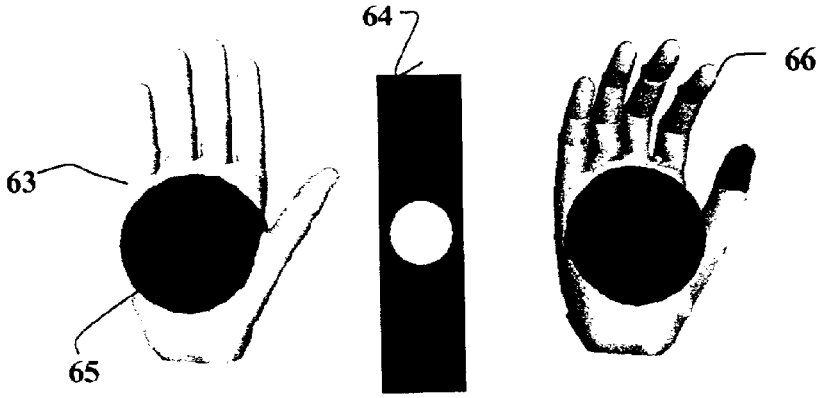
FIG. 6*a* is a pictorial representation of a virtual simulation of an exercise for speed of motion.

An example of a virtual simulation exercise for speed of movement 42 is designed as a "catch-the-ball game," as illustrated in FIG. 6*a*. The user competes against a computer-controlled opponent hand 63 on the left of the screen. On a "go" signal for example, a green light on traffic signal 64, the user closes either the thumb or all the fingers together as fast as possible to catch ball 65, such as a red ball which is displayed on virtual simulated user hand 66. At the same time, opponent hand 63 also closes its thumb or fingers around its ball. The angular velocity of opponent hand 63 goes from zero to the target angular velocity and then back to zero, following a sinusoid. If the patient surpasses the target velocity, then he beats the computer opponent and gets to keep the ball. Otherwise, the patient loses, and his ball falls, while the other ball remains in opponent's hand 63.

Figure 6B:
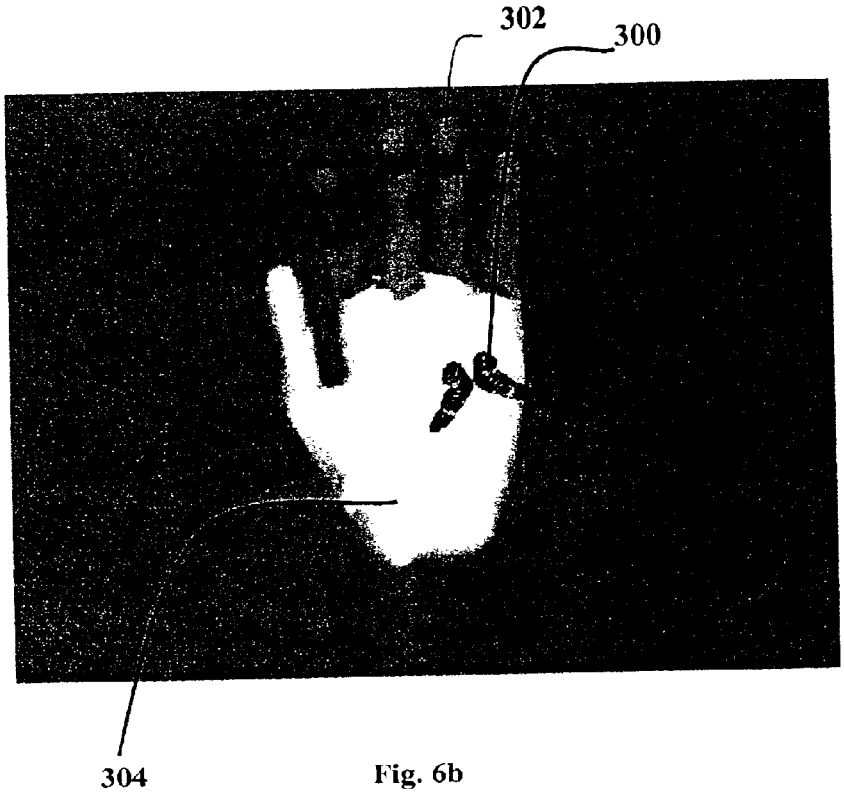
FIG. 6*b* is a pictorial representation of another version of the speed of motion exercise in virtual reality.

Another embodiment of the speed of movement exercised is illustrated in FIG. 6*b*. The game is designed as a "scare-the-butterfly" exercise. The patient wearing the sensing glove 12 has to close the thumb, or all the fingers, fast enough to make butterfly 300 fly away from virtual hand 302. If the patient does not move his fingers or thumb with enough speed which can be a function of target 22 then butterfly 300 continues to stay at the extremity of palm 304 of virtual hand 302.

Figure 7:
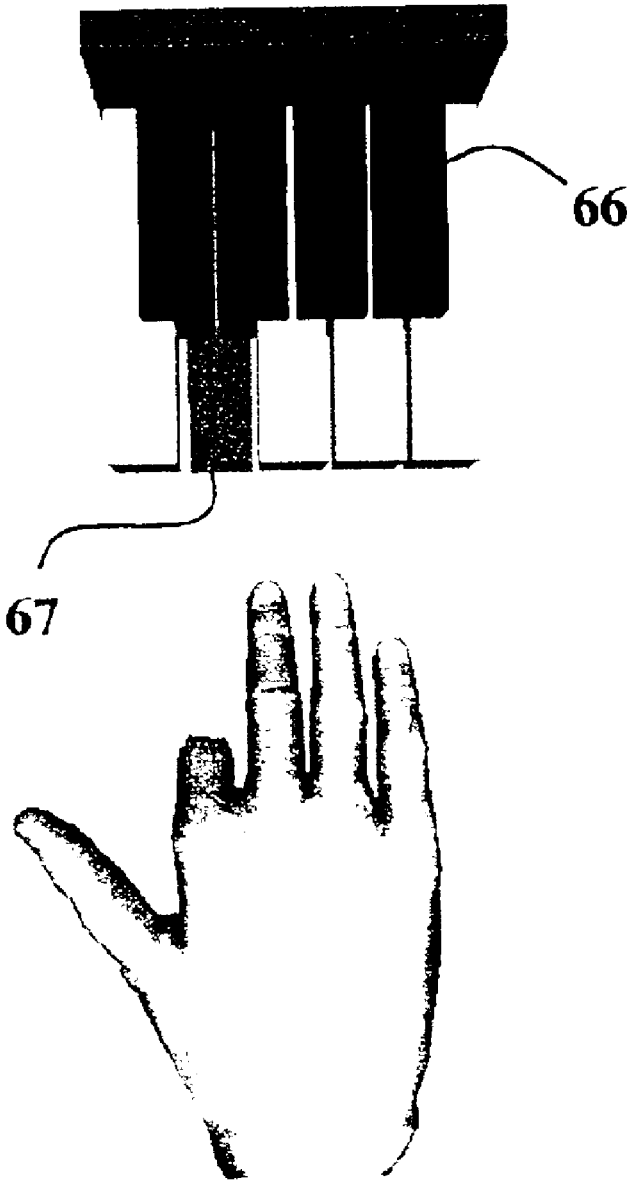
FIG. 7 is a pictorial representation of a virtual simulation of an exercise for finger fractionation.

An example of a virtual simulation exercise for fractionation 43 is illustrated in FIG. 7. The user interacts with a virtual simulation of a piano keyboard 66. As the active finger is moved, the corresponding key on the piano 67 is depressed and turns a color, such as green. Nearing the end of the move, the fractionation measure is calculated online, and if it is greater than or equal to the trial target measure, then only that one key remains depressed. Otherwise, other keys are depressed, and turn a different color, such as red, to show which of the other fingers had been coupled during the move. The goal of the patient is to move his hand so that only one virtual piano key is depressed for each trial. This exercise is performed while the patient wears sensing glove 12.

Figure 8:
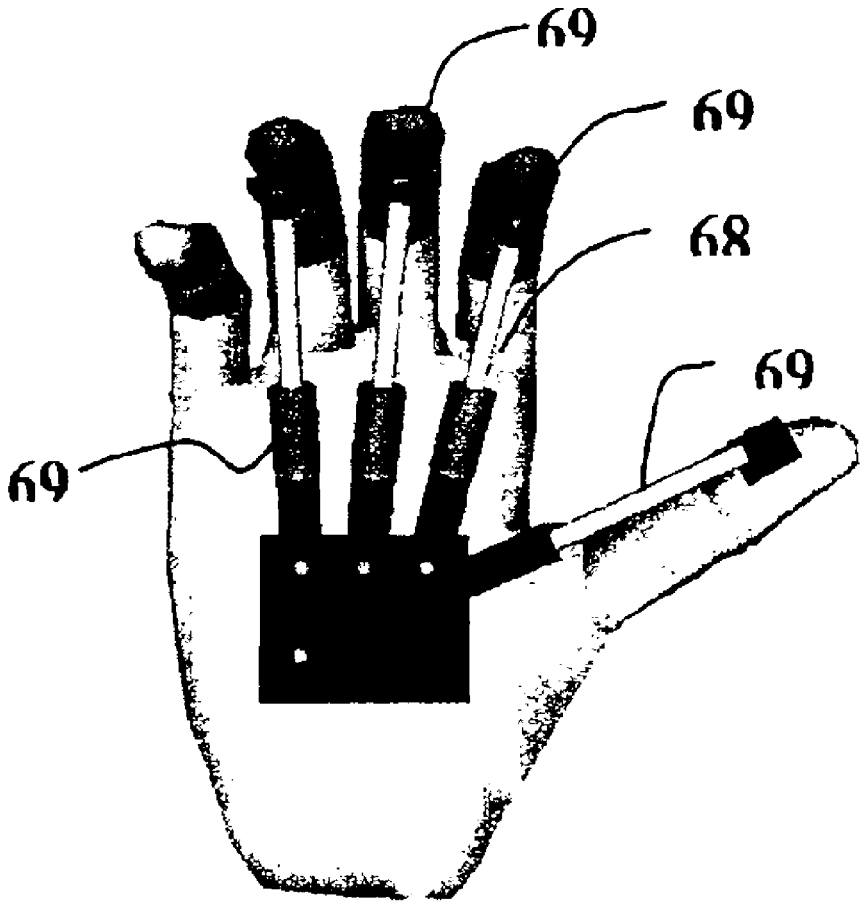
FIG. 8 is a pictorial representation of a virtual simulation of an exercise for strength of motion.

FIG. 8 illustrates a virtual simulation of an exercise for strength 44. A virtual model of a force feedback glove 68 is controlled by the user interaction with force feedback glove 13. The forces applied for each individual trial 54*a*–54*d* are taken from a normal distribution around the force level found in the initial evaluation. As each actuator 30 on the force feedback glove 13 is squeezed, each virtual graphical actuator 69 starts to fill from top to bottom in a color, such as green, proportional to the percentage of the displacement target that had been achieved. Virtual graphical actuator 69 turns yellow and is completely filled if the patient manages to move the desired distance against that particular force level.

Each actuator 30 of force feedback glove 13 has two fixed points: one in the palm, attached to exoskeleton base 34, and one attached to the fingertip. Virtual graphical actuator 69 is implemented with the same fixed points. In one implementation, the cylinder of virtual graphical actuator 69 is a child node of the palm graphical object, and the shaft is a child node of the fingertip graphical object. To implement the constraint of the shaft sliding up and down in the cylinder, for each frame, the transformation matrices of both parts are calculated in the reference frame of the palm. Then, the rotation of the parts is computed such that they point to one another.

Figure 9A:
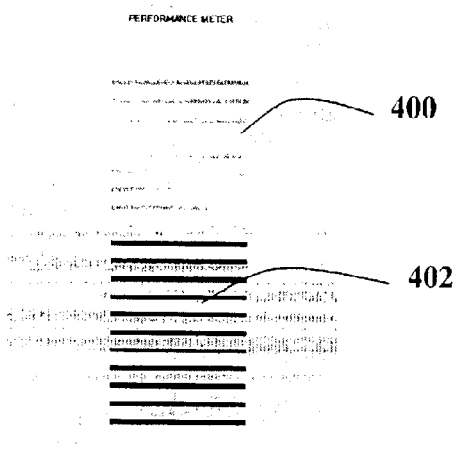
FIG. 9*a* is a pictorial representation of a graph for performance of the user following an exercise.

An example of digital performance meter visualizing the patient's progress is shown in FIG. 9*a*. After every trial is completed for any of the previously described virtual simulations of exercises 41–44, the patient is shown this graphical digital performance meter by virtual reality simulation module 18. Virtual digital performance meter visualizes the target level as a first color horizontal bar 400, such as red, and the user's actual performance during that exercise as similar second color bars 402, such as green and informs the user of how his performance compares with the desired one.

Figure 9B:
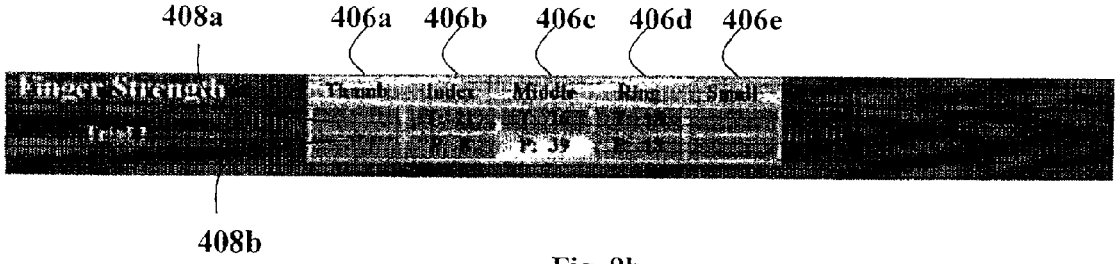
FIG. 9*b* is a pictorial representation of another version of the user performance graph during virtual reality exercising.

In another embodiment illustrated in FIG. 9*b*, the digital performance meter is displayed during the exercise, at the top of the screen graphical user interface. The performance meter is organized as a table. Columns 406*a–e* correspond to the thumb and fingers while rows 408*a–b* of numbers show target and instantaneous performance values. This embodiment presents the performance in numerical, rather than graphic format, and it displays it during rather than after the exercise. It has been found that this embodiment is motivates the patients to exercise, since they receive real-time performance feedback. If during the exercise the target has been matched or exceeded by the patient, that table cell changes color and flashes, to attract patient (or therapist's) attention.

Figure 10:
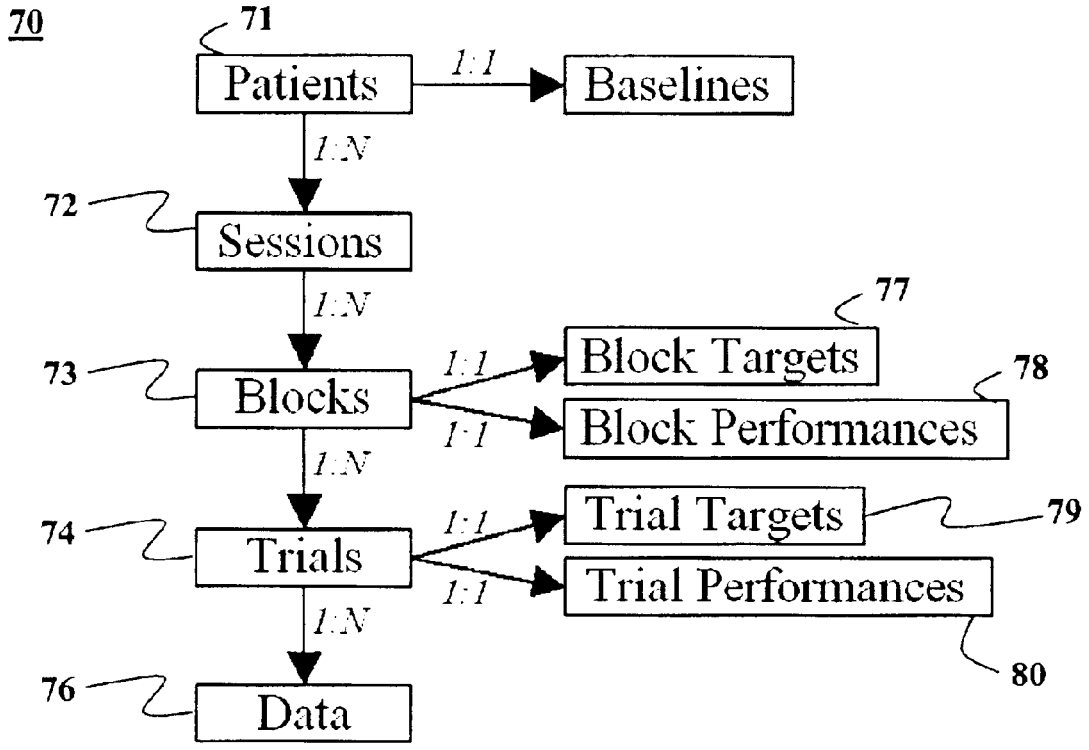
FIG. 10 is a schematic diagram of an arrangement of tables in a database.

FIG. 10 illustrates a structure 70 for storing data of exercises 41–44 in database 20. Database 20 provides expeditious as well as remote access to the data. Patient's table 71 stores information about the condition of the patient, prior rehabilitation training, and results of various medical tests. Sessions table 72 contains information about a rehabilitation session such as date, time, location, and hand involved. Blocks table 73 stores the type of the exercise, the glove used, such as sensing glove 12 or force feedback glove 13 and the version of the data. The version of the data is linked to an auxiliary table containing information about the data stored and the algorithms used to evaluate it. For each exercise, there is a separate trials table 74 containing mainly control information about the status of a trial. There are four data tables 76, one for each exercise. Data tables 76 store the sensor readings taken during the trials. For each exercise, there is a separate baselines data table 76 storing the results of the initial evaluation. The target and performance tables 77–80 contain this information computed from sensor readings.

A frequent operation on database 20 is to find out to whom an entry belongs. For example, it may be desirable to know which patient executed a certain trial 74*a–*74*d*. To speed up queries of database 20, the keys of tables on the top of map 70 are passed down more than one level. Due to the large size of the data tables 76, the only foreign key passed to them is the trial key. The data access is provided through a user name and password assigned to each patient and member of the medical team.

Figure 11A:
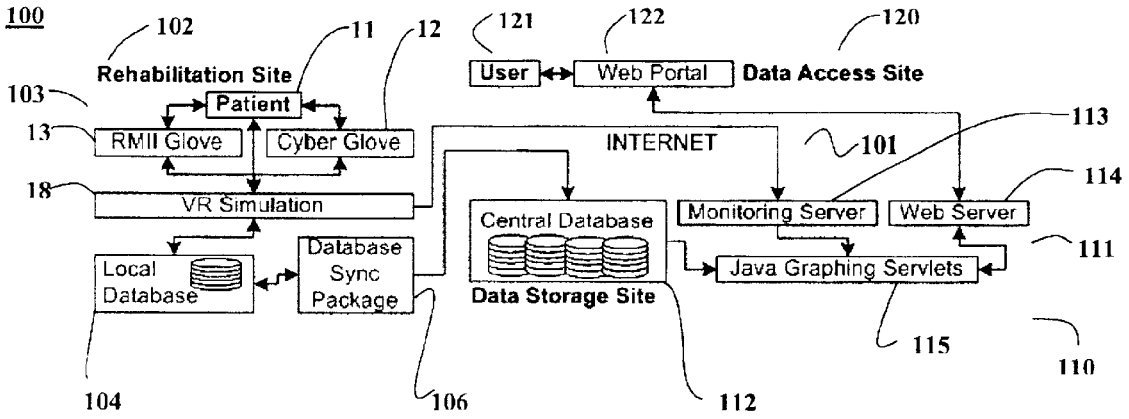
FIG. 11*a* is a schematic diagram of a distributed rehabilitation system.

FIG. 11*a* is a schematic diagram of distributed rehabilitation system 100. Rehabilitation system 100 is distributed over rehabilitation site 102, data storage site 110 and data access site 120 connected to each other through Internet 101. Rehabilitation site 102 is the location where the patient is undergoing upper extremity therapy. Rehabilitation site 102 includes computer workstation 103, sensing glove 12 and force feedback glove 13 and local database 104. Sensing glove 12, force feedback glove 13 are integrated with virtual reality simulation module 18 generating exercises running on computer workstation 103. The patient interacts with rehabilitation site 102 using sensing glove 12 and force feedback glove 13. Feedback is given on a display of computer workstation 103. Local database 104 stores data from virtual reality simulation module 18. Local database 104 interacts with a central database 112 of data storage site 110 using a data synchronization module 106.

Data storage site 110 is the location of main server 111. Main server 111 hosts central database 112, monitoring server 113 and web server 114. If the network connection is unreliable (or slow), then data is replicated from central database 112 in local database 104. Central database 112 is synchronized with local database 104 with a customizable frequency. Data access site 120 comprises computers with Internet access which can have various locations. Using web browser 121, a therapist or physician can access web portal 122 and remotely view the patient data from data access site 110. To provide the therapist with the possibility of monitoring the patient's activity the client-server architecture brings the data from rehabilitation site 102 to data storage site 110 in real-time. Main server 111 stores only the last record data. Due to the small size of the data packets and the lack of atomic transactions, the communication works even over a slow connection.

Web portal 122 can be implemented as Java applet that accesses the data through Java servlets 115 running on data storage site 110. The therapist can access stored data, or monitor active patients, through the use of web browser 121. Web portal 122 provides a tree structure for intuitive browsing of the data displayed in graphs such as performance histories (day, session, trial), linear regressions, or low-level sensor readings. For example, the graphs can be generated in PDF.

Figure 11B:
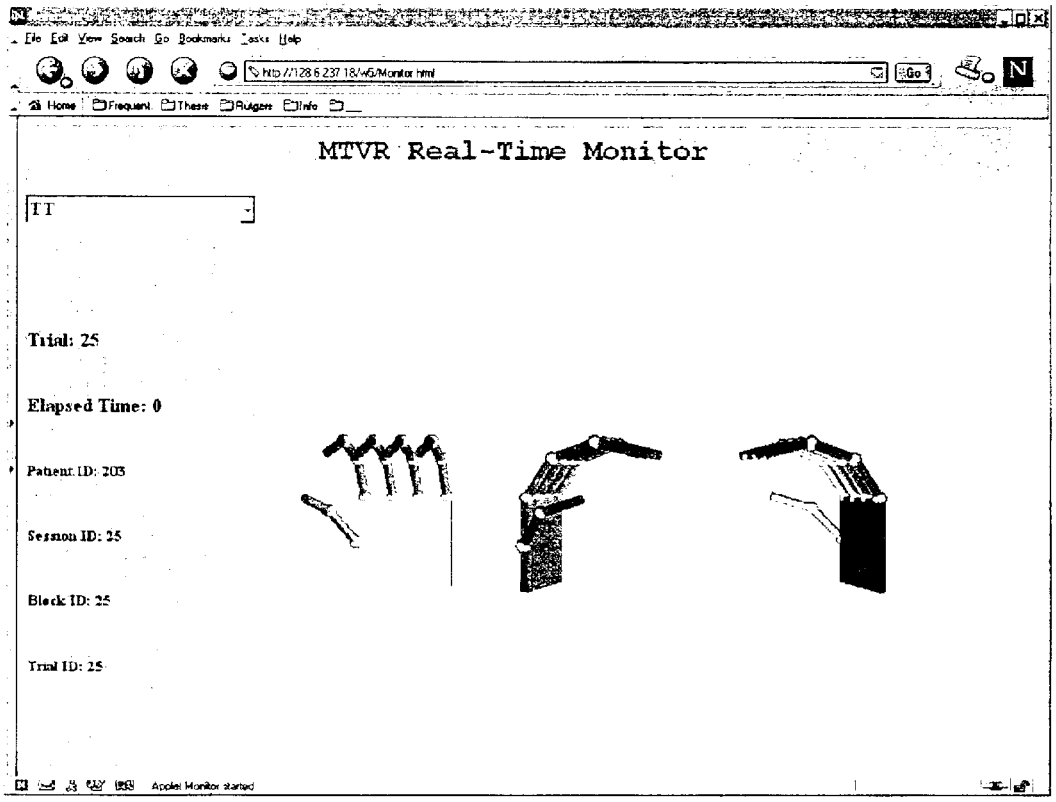
FIG. 11*b* is a detail of the patient monitoring server screen.

In one embodiment of the present inventions, virtual reality module 18 can provide real-time monitoring of the patient through a Java3D applet displaying a simplified virtual hand model, as illustrated in FIG. 11*b* The virtual hand's finger angles are updated with the data retrieved from monitoring server 113 at the data storage site. The therapist can open multiple windows of browser 121 for different patients, or select from multiple views of the hand of a given patient. The window at the monitoring site displays the current exercise session, or trial number as well as patient ID.

EXAMPLES

Rehabilitation system 10 was tested on patients during a two-week pilot study. All subjects were tested clinically, pre- and post-training, using the Jebsen test of hand function as described in R. H. Jebsen, N. Taylor, R. B. Trieschman, M. J. Trotter and L. A. Howard, "An Objective an Standardized Test of Hand Function," *Arch. Phys. Med. Rehab.*, Vol. 50, pp. 311–319, 1969, merely incorporated by reference into this applicant and the hand portion of the Fugel-Meyer assessment of sensorimotor recovery after stroke, as described in P. W. Duncan, M. Propst and S. G. Nelson, "Reliability of the Fugl-Meyer Assessment Sensorimotor Recovery Following Cerebrovascular Accident," *Phys. Therapy*, Vol. 63, No. 10, pp. 1606–1610, 1983, each incorporated by reference into this applicant. Grip strength evaluation using a dynamometer was obtained pre-, intra-, and post-training. In addition, subjective data regarding the subjects' affective evaluation of this type of computerized rehabilitation was also obtained pre-, intra-, and post-trial through structured questionnaires. Each subject was evaluated initially to obtain a baseline of performance in order to implement the initial computer target levels. Subsequently, the subjects completed nine daily rehabilitation sessions that lasted approximately five hours each. These sessions consisted of a combination of virtual reality simulations of exercises 41–44 using the PC-based system that alternated with non-computer exercises. Cumulative time spent on the virtual simulation exercises 41–44 during each day's training was approximately 1–1.5 hour per patient. The remainder of each daily session was spent on conventional rehabilitation exercises. Although a patient's "good" arm was never restrained, patients were encouraged to use their impaired arms and were supervised in these activities by a physical or occupational therapist. Conventional exercises comprise a series of game-like tasks such as tracing 2-D patterns on paper, peg-board insertion, checkers, placing paper clips on paper, and picking up objects with tweezers.

A. Patient Information

Three subjects, two male and one female, ages 50–83, participated in this study. They had sustained left hemisphere strokes that occurred between three and six years prior to the study. All subjects were right hand dominant and had had no therapy in the past two years. Two of the subjects were independent in ambulation and one required the assistance of a walker. None of the subjects was able to functionally use his or her hemiparetic right hand except as a minimal assist in a few dressing activities.

B. Baseline Patient Evaluation

Each virtual reality based exercise session consisted of four blocks of 10 trials each. Multiple sessions were run each day for five days followed by a weekend break and another four days. An individual block concentrated on performing one of exercises 41–44. Similar to the evaluation exercises, the patients were required to alternate between moving the thumb alone and then moving all the fingers together for every exercise except fractionation. The patient had to attain a certain target level of performance in order to successfully complete every trial. For a particular block 52*a*–52*d* of trials 54*a*–54*d* the first set of targets were drawn from a normal distribution around the mean and standard deviation given by the initial evaluation baseline test. A normal distribution ensured that the majority of the targets would be within the patient's performance limits, but the patient would find some targets easy or difficult depending on whether they came from the low or high end of the target distribution. Initially, the target means were set one standard deviation above the patient's actual measured performance to obtain a target distribution that overlapped the high end of the patient's performance levels.

The four blocks 52*a*–52*d* of respective exercises 41–44 were grouped in one session that took 15–20 min to complete. The sessions were target-based, such that all the exercises were driven by the patient's own performance. The targets for any particular block of trials were set based on the performance in previous sessions. Therefore, no matter how limited the patient's movement actually was, if their performance fell within their parameter range then they successfully accomplished the trial. Each exercise session consisted of four blocks 52*a*–52*d* of exercises 41–44 of 10 trials each of finger and thumb motions, or for fractionation only finger motion. The blocks 52*a*–52*d* were presented in a fixed order.

Figure 12A:
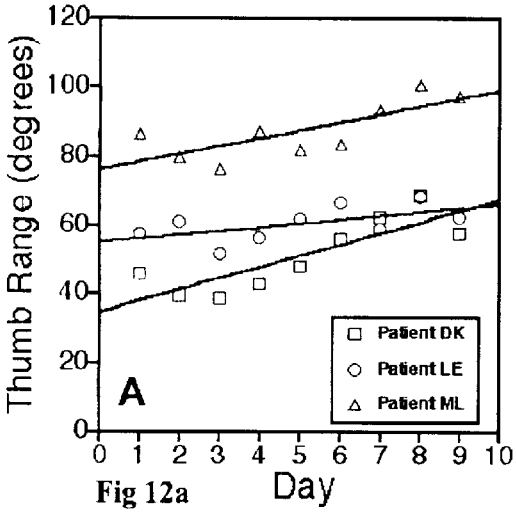
FIG. 12*a* is a graph of results for thumb range of motion.
Figure 12B:
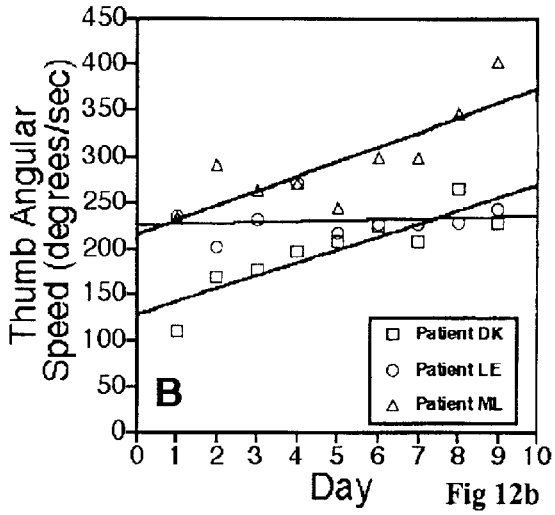
FIG. 12*b* is a graph of results for thumb angular velocity.
Figure 12C:
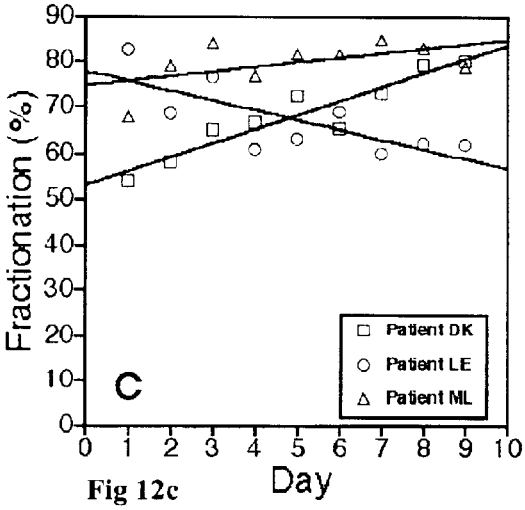
FIG. 12*c* is a graph of results for index finger fractionation.
Figure 12D:
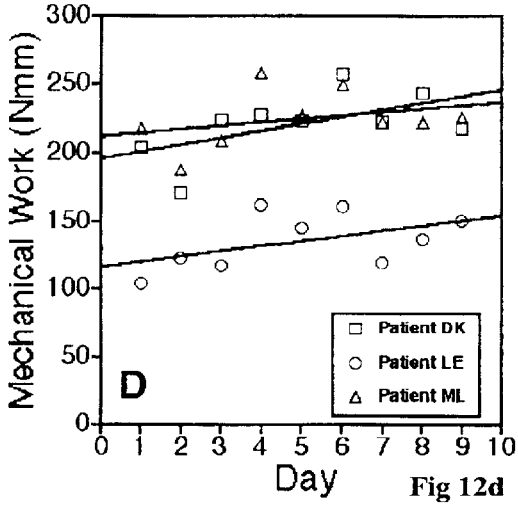
FIG. 12*d* is a graph of results for thumb average session mechanical work.

FIG. 12*a* represents the change in thumb range of motion for the three patients over the duration of the study. Data are averaged across sessions within each day's training. Calculation of improvements or decrements is based on the regression curves fit to the data. It can be seen that there is improvement in all three subjects, ranging from 16% in subject LE, who had the least range deficit, to 69% in subject DK, who started with a very low range of thumb motion of 38 degrees. FIG. 12*b* shows that the thumb angular speed remained unchanged (an increase of 3%) for subject LE and improved for the other two subjects by 55% and 80%, patient DK again showing the largest improvement. FIG. 12*c* presents the change in finger fractionation, i.e., the patients' ability for individuated finger control. For patients ML and DK, this variable showed improvement of 11% and 43%, respectively. Subject LE showed a decrease of 22% over the nine days. FIG. 12*d* shows the change in the average session's mechanical work of the thumb for the nine rehabilitation sessions. The three patients improved their daily thumb mechanical work capacity by 9–25%.

Figure 13A:
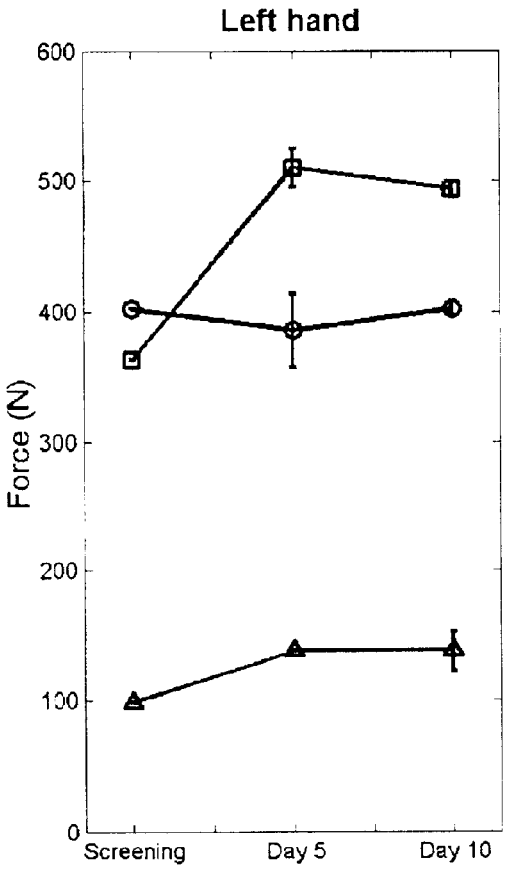
FIG. 13*a* is a graph of dynamometer readings for the left hand of subjects.
Figure 13B:
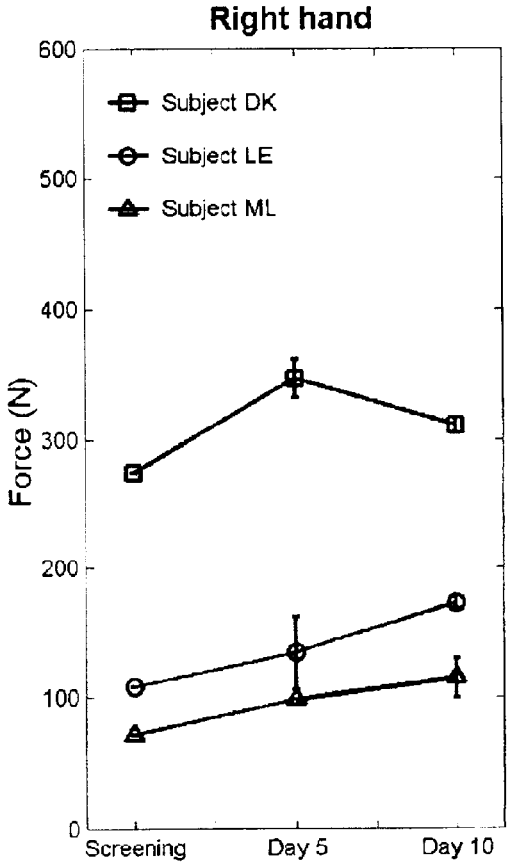
FIG. 13*b* is a graph of dynamometer readings for the right hand of subjects.

FIGS. 13*a*–13*b* show the patients' grasping forces measured with a standard dynamometer at the start, midway and at the end of therapy, for both the "good" (left) and affected (right) hands. It can be seen that all three patients improved their grasping force for the right hand, this improvement varying from 13% for the strongest patient to 59% for the other two. This correlates substantially with the 9–25% increase in thumb average session mechanical work ability shown in FIG. 12*d* for two of the patients. Patient LE had no improvement in his "good" hand and 59% improvement in his right-hand grasping force. Two of the patients had an improvement in the left-hand grasping force as well. Patient DK has a remarkably similar pattern in the change in grasping force for both hands. Other factors influencing grasping force capacity, such as self-motivation, confidence, and fatigue may be combined with influences from virtual simulation of exercises with rehabilitation device 10.

Figure 14:
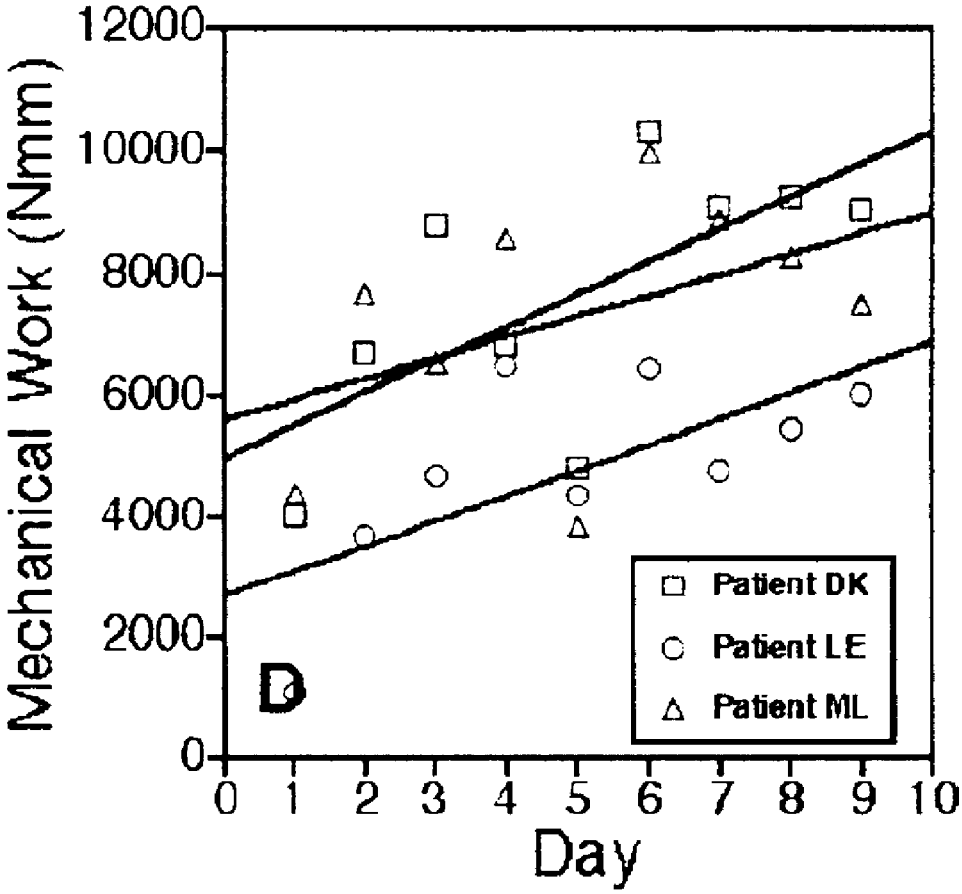
FIG. 14 is a graph of daily thumb mechanical work during virtual simulation of exercises.

If patient fatigue occurred, that may be correlated with the drop in right-hand grasping force shown in FIG. 13 for patient DK between the middle and end of therapy. The total daily mechanical work (sum of thumb effort over all sessions in a day) is shown in FIG. 14. Although the regression curve is positive for all three patients, daily values plateau and then drop for patient DK.

All three subjects showed positive changes on the Jebsen test scores, with each subject showing improvement in a unique constellation of test items. None of the tasks that were a part of the Jebsen battery was practiced during the non-virtual reality training activities.

Subsequently rehabilitation system 10 was tested on four other patients that had left-hand deficits due to stroke. As opposed to the first study, this time only virtual reality exercises of the type shown in FIGS. 5–8 were done. There was no non-VR exercises done by the patients.

Each of four patients exercised for three weeks, five days/week, for approximately one and half hours. The structure of the rehabilitation was previously described. Similar improvements in finger range of motion, fractionation, speed of motion and strength were observed.

Figure 15:
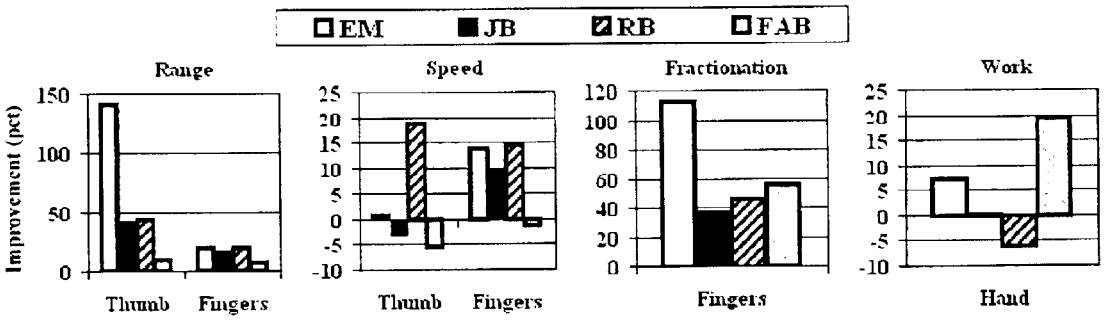
FIG. 15 shows improvement from four patients using the rehabilitation system.

FIG. 15 shows the improvement for the four patients over the three weeks of therapy using the rehabilitation system 10. It can be noted that three subjects had substantial improvement in range of motion for the thumb (50–140%), while their gains in finger range were more modest (20%). One patient had an 18% increase in thumb speed and three had between 10–15% speed increases for their fingers. All patients improved their finger fractionation substantially (40–118%). Only one subject showed substantial gain in finger strength, in part due to unexpected hardware problems during the trial. This subject had the lowest levels of isometric flexion force prior to the therapy.

Figure 16:
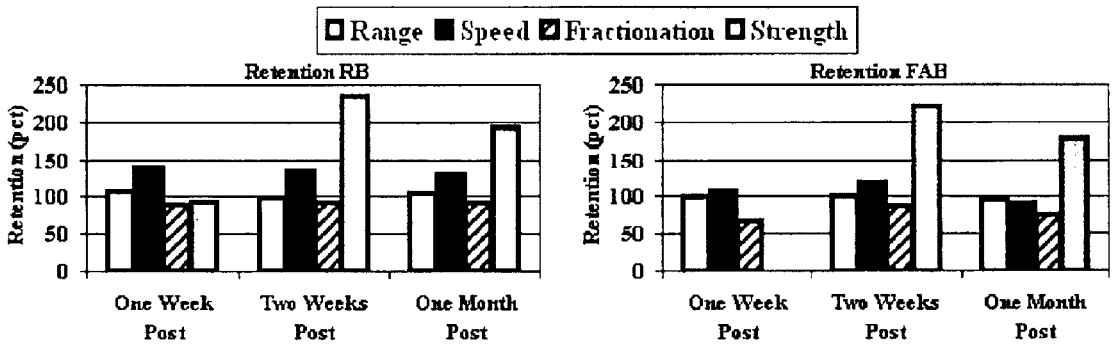
FIG. 16 shows the rehabilitation gains made in two patients.

FIG. 16 shows the retention of the gains made in therapy in the two patients that were measured, again for the four variables for which they trained. Their range and speed of motion either increased (patient RB) or decreased marginally (patient FAB) at one-month post therapy. Their finger strength increased significantly (about 80%) over the month following therapy, indicating they had reserve strength that was not challenged during the trials.

Figure 17:
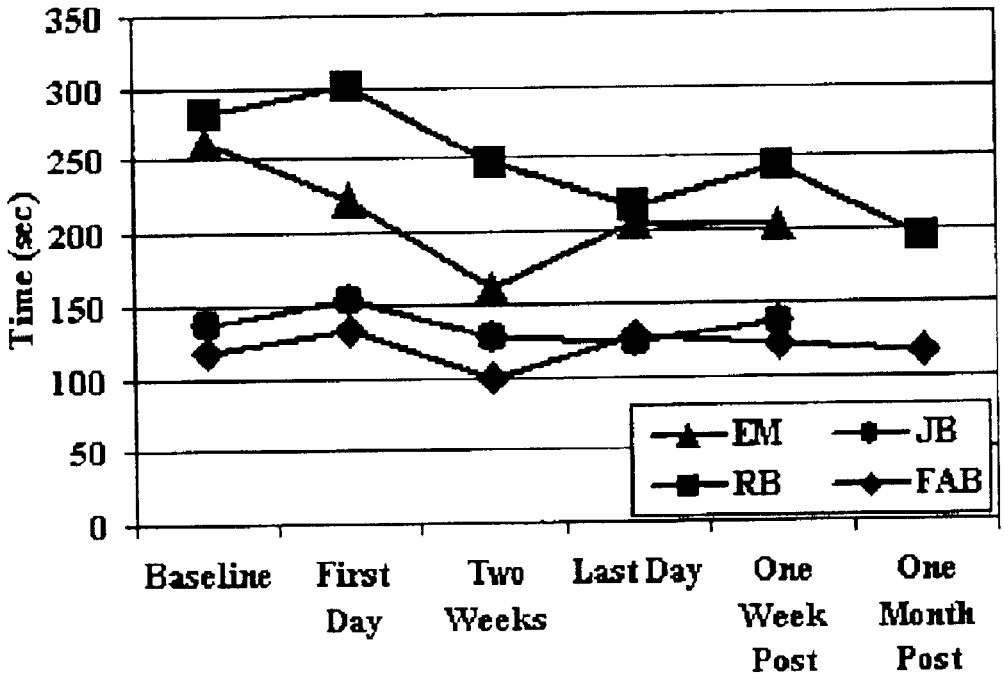
FIG. 17 shows the results of a Jebsen evaluation.

FIG. 17 shows the results of the Jebsen evaluation, namely the total amount of time it took the patients to complete the seven component manual tasks. It can be seen that two of the patients (RB and EM) had a substantial reduction in the time from the measures taken prior to the intervention (23–28%, respectively). There was essentially no change in the Jebsen test for the other two patients (JB and FAB). Most of the gains occurred early in the intervention, with negative gains in the second half of the trials.

Figure 18:
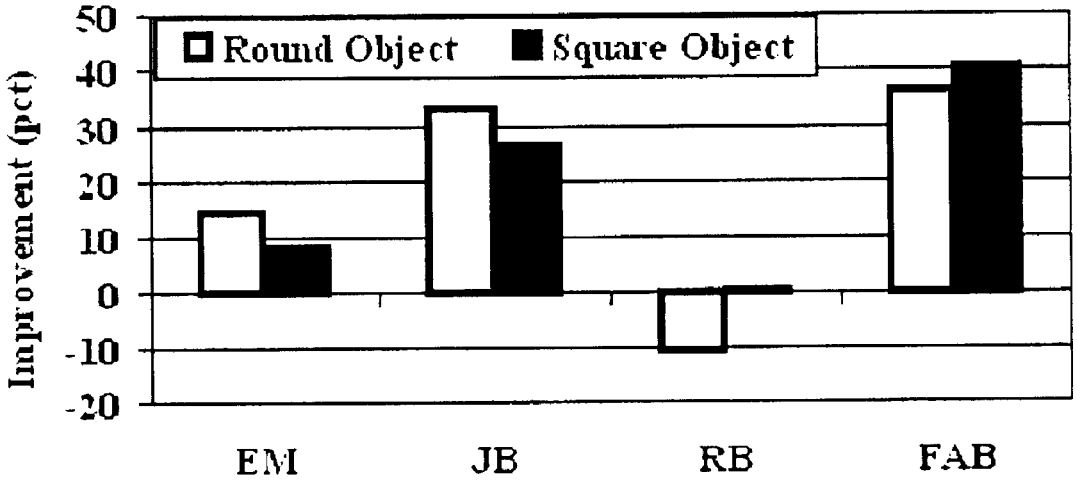
FIG. 18 shows the transfer-of-training results for a reach-to-grab task.

FIG. 18 shows the transfer-of-training results for a reach-to-grasp task, measuring the time it took patients to pick up an object. There was no training of this particular task during the trials. However, results indicate improvements in impairments appeared to transfer to this functional activity, as measured by the reduction in task movement time. Three of the patients had improvements of between 15% and 38% for a round object and between 9% and 40% for a square object. There was no change for subject RB for picking up a square object while the time to pick up a round object increased by about 11%.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

What is claimed is:

1. A system for rehabilitation of a neuromotor disorders of a user comprising:

sensing means adapted for sensing position of one or more digits of a hand of said user to provide first sensor data;

force feedback means adapted for applying force feedback to said one or more digits and for measuring position of a tip of each of said one or more digits in relation to a palm of said hand to provide second sensor data;

virtual reality simulation means for determining a virtual image of virtual objects movable by said user to virtually simulate an exercise adapted to be performed by said user, said virtual reality simulation means receiving said first sensor data and said second sensor data and determining performance of said user from said first sensor data and said second sensor data; and means for establishing one or more targets from said performance of said user and means for displaying said one or more targets to said user, wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits.

2. The system of claim 1 wherein said exercise is a range of motion exercise.

3. The system of claim 1 wherein said exercise is a speed of motion exercise.

4. The system of claim 1 wherein said exercise is a fractionation exercise of said one or more digits.

5. The system of claim 1 wherein said exercise is a strength exercise.

6. The system of claim 1 wherein said exercise is executed with all fingers of said one or more digits and is executed separately with a thumb of said one or more digits.

7. The system of claim 1 wherein said sensing means is a sensor glove.

8. The system of claim 7 wherein said sensor glove provides one or more measurements selected form the group consisting of: metacarpophalangeal (MCP) joint angle of a thumb of said one or more digits and a finger of said one or more digits, proximal interphalangeal (PIP) joint angle of a thumb of said one or more digits and a finger of said one or more digits, finger abduction and wrist flexion;

performance is measured from:

$$\max\left(\frac{MCP+2}{2}\right)-\min\left(\frac{MCP+PIP}{2}\right).$$

9. The system of claim 1 wherein said targets are displayed in real time as numerical values.

10. The system of claim 1 wherein said targets are displayed graphically as horizontal bars changing color to indicate achievement of said target.

11. The system of claim 1 wherein said exercise is a range of motion exercise and said virtual object is a window wiper moving over a fogged window wherein as said window wiper is moved over a virtual position of said fogged window a picture is revealed at said virtual position.

12. The system of claim 1 wherein said exercise is a speed of movement exercise and said virtual object is a traffic light and a virtual hand catching a first virtual ball, wherein on a change of a signal of said traffic light said user closes said one or more digits for interacting with said virtual image to catch said first virtual ball.

13. The system of claim 1 wherein said exercise is a speed of movement exercise and said virtual object is a virtual hand and virtual butterfly, wherein said user moves said one or more digits for interacting at a predetermined speed with said virtual image to make said virtual butterfly fly away from said virtual hand.

14. The system of claim 13 further comprising a virtual opponent including a second virtual hand catching a second virtual ball, wherein if said user catches said first virtual ball before said opponent catches said second virtual ball said first virtual ball remains on said virtual hand or if said user catches said first virtual ball after said virtual opponent catches said second virtual ball said first virtual ball falls from said virtual hand.

15. The system of claim 1 wherein said exercise is a fractionation exercise and said virtual object is a piano keyboard with one or more keys, wherein one as said one or more digits is moved a corresponding said key turns a different color.

16. The system of claim 1 wherein said exercise is a strength exercise and said virtual object is virtual force feedback glove, wherein said force feedback means comprises a force feedback glove having an actuator associated with said one or more digits and as said respective actuators are depressed by said one or more digits of said user a corresponding virtual actuator on said virtual force feedback glove is filled with a color.

17. The system of claim 16 wherein said color changes depending on achievement of a percentage of a target of said performance.

18. The system of claim 1 wherein said force feedback means is a force feedback glove.

19. The system of claim 18 wherein said force feedback glove comprises one or more actuators each coupled to a respective said one or more digits.

20. The system of claim 19 wherein said force feedback glove further comprises one or more sensors each coupled to a respective said one or more actuators.

21. The system of claim 1 wherein said neuromotor disorder is a stroke.

22. The system of claim 1 further comprising storing means for storage of one or more of said virtual image, said first sensor data, said second sensor data and said performance.

23. The system of claim 22 wherein said storing means is a database.

24. A system for rehabilitation of a neuromotor disorders of a user comprising:

sensing means adapted for sensing position of one or more digits of a hand of said user to provide first sensor data, said sensing means is a sensor glove, said sensor glove provides one or more measurements selected form the group consisting of: metacarpophalangeal (MCP) joint angle of a thumb of said one or more digits and a finger of said one or more digits, proximal interphalangeal (PIP) joint angle of a thumb of said one or more digits and a finger of said one or more digits, finger abduction and wrist flexion;

force feedback means adapted for applying force feedback to said one or more digits and for measuring position of a tip of each of said one or more digits in relation to a palm of said band to provide second sensor data; and virtual reality simulation means for determining a virtual image of virtual objects movable by said user to virtually simulate an exercise adapted to be performed by said user, said virtual reality simulation means receiving said first sensor data and said second sensor data and determining performance of said user from said first sensor data and said second sensor data, wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits, said exercise is a range of motion exercise and said performance is measured from:

$$\max\left(\frac{MCP+2}{2}\right)-\min\left(\frac{MCP+PIP}{2}\right).$$

25. A system for rehabilitation of a neuromotor disorders of a user comprising:

sensing means adapted for sensing position of one or more digits of a hand of said user to provide first sensor data, said sensing means is a sensor glove, said sensor glove provides one or more measurements selected form the group consisting of: metacarpophalangeal (MCP) joint angle of a thumb of said one or more digits and a finger of said one or more digits, proximal interphalangeal (PIP) joint angle of a thumb of said one or more digits and a finger of said one or more digits, finger abduction and wrist flexion;

force feedback means adapted for applying force feedback to said one or more digits and for measuring position of a tip of each of said one or more digits in relation to a palm of said hand to provide second sensor data; and virtual reality simulation means for determining a virtual image of virtual objects movable by said user to virtually simulate an exercise adapted to be performed by said user, said virtual reality simulation means receiving said first sensor data and said second sensor data and determining performance of said user from said first sensor data and said second sensor data, wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits, said exercise is speed of motion exercise and said performance is measured from:

$$\max\left(\frac{speed(MCP)+speed(PIP)}{2}\right)$$

wherein speed(MCP) is a mean of an angular velocity of said MCP joint angle and speed(PIP) is a mean of an angular velocity of said PIP joint angle.

26. A system for rehabilitation of a neuromotor disorders of a user comprising:

sensing means adapted for sensing position of one or more digits of a hand of said user to provide first sensor data, said sensing means is a sensor glove, said sensor glove provides one or more measurements selected form the group consisting of: metacarpophalangeal (MCP) joint angle of a thumb of said one or more digits and a finger of said one or more digits, proximal interphalangeal (PIP) joint angle of a thumb of said one or more digits and a finger of said one or more digits, finger abduction and wrist flexion;

force feedback means adapted for applying force feedback to said one or more digits and for measuring position of a tip of each of said one or more digits in relation to a palm of said hand to provide second sensor data; and virtual reality simulation means for determining a virtual image of virtual objects movable by said user to virtually simulate an exercise adapted to be performed by said user, said virtual reality simulation means receiving said first sensor data and said second sensor data and determining performance of said user from said first sensor data and said second sensor data, wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits, said exercise is a fractionation exercise of said one or more digits and said performance is measured from:

$$100\%\left(1-\frac{\sum PassiveFingerRange}{3\ ActiveFingerRange}\right)$$

where ActiveFingerRange is the current average joint range of the finger being moved and PassiveFingerRange is the current average joint range of the other three fingers combined.

27. A system for rehabilitation of a neuromotor disorders of a user comprising:

sensing means adapted for sensing position of one or more digits of a hand of said user to provide first sensor data, said sensing means is a sensor glove, said sensor glove provides one or more measurements selected form the group consisting of: metacarpophalangeal (MCP) joint angle of a thumb of said one or more digits and a finger of said one or more digits, proximal interphalangeal (PIP) joint angle of a thumb of said one or more digits and a finger of said one or more digits, finger abduction and wrist flexion;

force feedback means adapted for applying force feedback to said one or more digits and for measuring position of a tip of each of said one or more digits in relation to a palm of said hand to provide second sensor data; and virtual reality simulation means for determining a virtual image of virtual objects movable by said user to virtually simulate an exercise adapted to be performed by said user, said virtual reality simulation means receiving said first sensor data and said second sensor data and determining performance of said user from said first sensor data and said second sensor data, wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits, said exercise is strength exercise and said performance is measured from:

$$\max\left(\frac{MCP+2}{2}\right)-\min\left(\frac{MCP+PIP}{2}\right).$$

28. A method for rehabilitation of a neuromotor disorder of a user comprising:

determining a virtual image of a virtual object movable by said user to virtually simulate an exercise adapted to be performed by said user;

sensing position of one or more digits of a hand of said user as said user interacts with said virtual image to provide first sensor data;

applying force feedback to said one or more digits of said hand in response to said virtual image and measuring position of a tip of each of said one or more digits in relation to a palm of said hand after said force feedback is applied to provide second sensor data;

determining performance of said user from said first sensor data and said second sensor data;

updating said virtual image in response to said performance of the user during said exercise;

establishing one or more targets from said performance of said user; and displaying said one or more targets to said user, wherein said virtual image is updated based on said one or more targets.

29. The method of claim 28 wherein said exercise is a range of motion exercise.

30. The method of claim 28 wherein said exercise is a speed of motion exercise.

31. The method of claim 28 wherein said exercise is a fractionation exercise of said one or more digits.

32. The method of claim 28 wherein said exercise is a strength exercise.

33. The method of claim 28 wherein said exercise is executed with all fingers of said one or more digits and executed separately with a thumb of said one or more digits.

34. The method of claim 28 wherein said sensing step comprises wearing a sensor glove.

35. The method of claim 28 wherein said exercise is a range of motion exercise and said virtual object is a window wiper moving over a fogged window wherein as said window wiper is moved over a virtual position of said fogged window a picture is revealed at said virtual position.

36. The method of claim 28 wherein said exercise is a speed of movement exercise and said virtual object is a traffic light and a virtual hand catching a first virtual ball, wherein on a change of a signal of said traffic light said user closes said one or more digits for catching said first virtual ball.

37. The method of claim 28 further comprising a virtual opponent including a second hand catching a second virtual ball, wherein if said user catches said first virtual ball before said opponent catches said second virtual ball said first virtual ball remains on said hand or if said user catches said first virtual ball after said virtual opponent catches said second virtual ball said first virtual ball falls from said virtual hand.

38. The method of claim 28 wherein said exercise is a fractionation exercise and said virtual object is a piano keyboard with one or more keys, wherein one as said one or more digits is moved a corresponding said key turns a different color.

39. The method of claim 28 wherein said exercise is a strength exercise and said virtual object is a virtual force feedback glove.

40. The method of claim 28 wherein said force feedback step comprises wearing a force feedback glove on said hand.

41. The method of claim 40 wherein said force feedback glove comprises one or more actuators each coupled to a respective said one or more digits.

42. The method of claim 41 wherein said force feedback glove further comprises one or more sensors each coupled to a respective said one or more actuators.

43. A method for rehabilitation of a stroke patient comprising:

determining a plurality virtual images each virtual image simulating an exercise adapted to be performed by said patient;

sensing position of one or more digits of a hand during interaction of said patient with each said virtual image to provide first sensor data;

optionally applying force feedback to said one or more digits of said hand of said patient in response to one of said virtual images and measuring position of a tip of each of said one or more digits in relation to a palm of said hand if said force feedback is applied to provide second sensor data;

determining performance of said user from said first sensor data or said second sensor data;

establishing one or more targets from said performance of said user;

displaying said one or more targets to said user, and updating said plurality of virtual images in response to said performance of the user during said respective exercises;

wherein said virtual image is updated based on said one or more targets.

44. A method for rehabilitation of a stroke patient comprising:

determining a plurality virtual images each virtual image simulating an exercise selected from the group consisting of a range of motion exercise, a range of speed exercise, fractionation exercise and a strength exercise;

sensing position of one or more digits of a hand during interaction of said patient with each respective said virtual image simulating said range of motion exercise, said range of speed exercise, and said fractionation exercise to provide first sensor data;

applying force feedback to said one or more digits of said hand of said patient in response to said virtual image simulating said strength exercise and measuring position of a tip of each of said one or more digits in relation to a palm of said hand after said force feedback is applied to provide second sensor data;

determining performance of said patient from said first sensor data or said second sensor data;

establishing one or more targets from said performance of said user;

displaying said one or more targets to said user, and updating said plurality of virtual images in response to said performance of said patient during said respective exercises;

wherein said virtual image is updated based on said one or more targets.

45. The method of claim 44 wherein said interaction of said patient with each respective said virtual image is repeated a predetermined number of times for each exercise.

46. The method of clam 44 wherein said force feedback is repetitively applied to said patient a predetermined number of times.

47. A system for rehabilitation of a stroke patient comprising:

means for determining a plurality virtual images each virtual image simulating an exercise selected from the group consisting of a range of motion exercise, a range of speed exercise, fractionation exercise and a strength exercise;

means for sensing position of one or more digits of a hand during interaction of said patient with each respective said virtual image simulating said range of motion exercise, said range of speed exercise, and said fractionation exercise to provide first sensor data;

means for applying force feedback to said one or more digits of said hand of said patient in response to said virtual image simulating said strength exercise;

means for measuring position of a tip of each of said one or more digits in relation to a palm of said hand of said patient after said force feedback is applied to provide second sensor data;

means for determining performance of said patient from said first sensor data and said second sensor data; means for establishing one or more targets from said performance of said user and means for displaying said one or more targets to said user, and means for updating said plurality of virtual images in response to said performance of the user during said respective exercises;

wherein in response to said performance of the user during said exercise said virtual reality simulation means controls updating of said virtual image and said force feedback means, said force feedback means being controlled to move said one or more digits to a position represented by said virtual image or to apply said force feedback to said one or more digits.

48. A distributed system for rehabilitation of a stroke patient comprising:

a rehabilitation site comprising sensing means adapted for sensing position of one or more digits of a hand of said patient to provide first sensor data, force feedback means adapted for applying force feedback to said one or more digits of hand and for measuring position of a tip of each of said one or more digits in relation to a palm of said hand to provide second sensor data, and virtual reality simulation means for determining at least one virtual image of one or more virtual objects movable by said patient to virtually simulate an exercise adapted to be performed by said user, said virtual reality simulation means receiving said first sensor data and said second sensor data and updating performance data of said patient from said first sensor data and said second sensor data, said virtual reality simulation means controlling determination of said at least one virtual image and controlling said force feedback means in response to said performance of the patient during said exercise means for establishing one or more targets from said performance of said user and means for displaying said one or more targets to said user wherein in response to said performance of the user during said exercise, said virtual reality simulation means controls updating of said virtual image and said force feedback means, said force feedback means being controlled to move said one or more digits to a position represented by said virtual image or to apply said force feedback to said one or more digits;

a data storage site for storing said virtual images and said performance data; and a data access site for remotely reviewing said virtual images and performance data.

49. The distributed system of claim 48 wherein said rehabilitation site, said data storage site and said data access site are connected to each other through an Internet connection.

* * * * *